United States Patent [19]

Suprono

[11] Patent Number: 4,701,000

[45] Date of Patent: Oct. 20, 1987

[54] ELECTRICAL TERMINAL AND METHOD OF ASSEMBLY

[75] Inventor: Paul W. Suprono, East Greenwich, R.I.

[73] Assignee: Nortek Corporation, Providence, R.I.

[21] Appl. No.: 730,297

[22] Filed: May 3, 1985

[51] Int. Cl.[4] ..... H01R 4/24

[52] U.S. Cl. ..... 439/423

[58] Field of Search ..... 339/95 D

[56] References Cited

U.S. PATENT DOCUMENTS

| | | | |
|---|---|---|---|
| 2,725,544 | 11/1955 | Strange | 339/95 |
| 2,968,780 | 1/1961 | Roswell | 339/17 |
| 2,997,686 | 8/1961 | Mason | 339/95 D |
| 3,093,433 | 6/1963 | Ege | 339/95 D |
| 3,324,447 | 6/1967 | Pistey | 339/95 |
| 3,417,368 | 12/1968 | Norden | 339/147 |
| 3,596,229 | 7/1971 | Hohorst | 339/95 D |
| 3,646,582 | 2/1972 | Van Alphen et al. | 339/95 D |
| 3,671,925 | 6/1972 | Drapkin | 339/95 D |
| 3,821,693 | 6/1974 | Dechelette | 339/217 S |
| 3,864,007 | 2/1975 | Plyler et al. | 339/17 LC |
| 3,916,149 | 10/1975 | Skinner | 219/335 |
| 3,937,548 | 2/1976 | Dittmann | 339/95 D |
| 3,945,711 | 3/1976 | Hohorst | 339/95 D |
| 4,046,445 | 9/1977 | Anhalt | 339/95 D |
| 4,087,149 | 5/1978 | Fischer | 339/95 D |
| 4,150,864 | 4/1979 | Walter | 339/19 |
| 4,212,509 | 7/1980 | Brooks et al. | 339/95 D |
| 4,217,021 | 8/1980 | Illum | 339/95 D |

FOREIGN PATENT DOCUMENTS

| | | | |
|---|---|---|---|
| 2619035 | 11/1977 | Fed. Rep. of Germany | 339/95 D |
| 1536189 | 12/1978 | United Kingdom | 339/95 D |

*Primary Examiner*—Joseph H. McGlynn

[57] ABSTRACT

A terminal for making electrical connection to a conductor has a base and a gripper that is held in a fixed position along the length of the base by a gripping finger that acts in tension in one direction at one location along the length of the base and a back portion that acts in the opposite direction at a second location along the length of the base to resist the tension. In other aspects, the supporting leg makes contact with the base only at locations that are not as near to the end of the conductor as the locations at which the gripping finger presses the conductor; the pressing of the conductor into contact with the base is accomplished only by resilience of the gripping finger along a section that does not extend beyond the end of the base; the base has a number of troughs of different dimensions that respectively seat wires of different gauges; and the terminal is assembled by inserting the base in an opening defined by the force end of the supporting leg and gripping finger to a position in which the free end of the gripper contacts the base at a pivot point, and rotating the gripper about the pivot point until the back portion contacts the end of the base and the free end of the gripper engages a projection on the base.

31 Claims, 11 Drawing Figures

ELECTRICAL TERMINAL AND METHOD OF ASSEMBLY

BACKGROUND OF THE INVENTION

This invention relates to terminals for making electrical connection to an electrical conductor, e.g., a wire.

In some such terminals, the wire can be securely connected by pushing a free end of the wire into the terminal. The free end is held between a metal supporting base and a springy metal gripper that has a burred edge to grab the wire, preventing it from being withdrawn. The gripper is oriented at such an angle to the base that when the wire is inserted it forces an opening between the gripper and the base. In various kinds of terminals the gripper and the base are permanently assembled by stitching or crimping, or are formed from a single piece, or are held in proper orientation by a plastic housing.

Fischer, U.S. Pat. No. 4,087,149, shows a terminal in which the base is a conventional flat plug tang of the kind used with electrical appliances; and the gripper is bow-shaped and has one long limb that rests along one side of the tang and a shorter gripping finger that has the burred edge. The wire is held between the tang and the finger. The long limb has a nipple that sits in a hole in the tang to prevent the gripper from sliding off the base.

SUMMARY OF THE INVENTION

One general feature of the invention is a terminal that has a base and a gripper that is held in a fixed position along the length of the base by having the gripping finger act in tension in one direction at a first location along the length of the base and having a back portion of the gripper act in the opposite direction at a second location spaced apart along the length of the base from the first location to resist the tension.

Preferred embodiments of the invention include the following features. The base has a projection at the first location and an end of the base is at the second location. The base is sheet metal and the projection is a flap bent away from the metal sheet. The base includes a trough for seating the free end of the conductor, and a shoulder adjacent to the trough bears the projection. The gripper also has a supporting leg (connected to the back portion) that contacts the base on the opposite side from the side on which the conductor is pressed into contact with the base. The terminal is adapted to make contact to a plurality of conductors and there are a plurality of gripping fingers (defined by parallel slits in the gripper) for respective conductors. The base has a trough, shallower than the thickness of the conductor, for seating each conductor. The back portion has a hole colinear with the trough to receive the conductor. The gripping finger has a burred edge which presses against the conductor. The gripping finger is oriented at an acute angle to the supporting leg (e.g., 45° when the conductor is not being held in the terminal). The base and the gripper cooperate to form a self-supporting assembly. The conductor is 12-gauge wire. The base is a high-copper-content brass alloy and the gripper is stainless steel. The terminal is housed in an insulative housing. The base also includes a male prong or a female receptacle that mates with a prong or receptable of another terminal. The terminal is part of a male or female connector which is part of a modular cable. The gripper fits over one end of the terminal and holds one conductor, and a second gripper fits over another terminal to hold another conductor. The base includes metal surface that makes electrical contact with the conductor.

Another general feature of the invention is a terminal in which the supporting leg of the gripper makes contact with the base only at locations that are not as near to the end of the conductor as the locations at which the gripping finger presses the conductor.

In preferred embodiments, the supporting leg has a flat portion that lies along the base beginning at the end opposite the end of the conductor; and the gripping finger presses the conductor at a single location.

Another general feature of the invention is a terminal in which the pressing of the conductor into contact with the base is accomplished only by resilience of the gripping finger along a section that does not extend beyond the end of the base.

Another general feature of the invention is a terminal in which the base has a plurality of troughs of different dimensions for respectively seating wires of different gauges.

Another general feature of the invention is a method for assembling a self-supporting terminal in which the base is inserted in an opening defined by the free ends of the supporting leg and gripping finger to a position in which the free end of the gripper contacts the base at a pivot point, and the gripper is rotated about the pivot point until the back portion contacts the end of the base and the free end of the gripper engages a projection on the base.

The terminal of the invention is easily, simply, and economically fabricated and is self-supporting without requiring welding, stitching, or crimping. The terminal will retain the wire even though the material of the insulative housing may flow. The base can be easily and simply fabricated of high-conductivity material to provide an excellent electrical connection. The gripper can be easily and simply fabricated from heat-treatable stainless steel. Many wires of different gauge can be accommodated in a single terminal. Limiting the spring moment to a short section of the gripper and keeping the gripping finger at an angle of 45° to the supporting leg assures a secure connection. The troughs assure good contact and permit relatively easy insertion of the conductor. The burred edge assures a tight grip. The terminal can be part of an inexpensively fabricated modular cable or can be used to interconnect a number of individual wires.

Other advantages and features of the invention will become apparent from the following description of the preferred embodiment, and from the claims.

DESCRIPTION OF THE PREFERRED EMBODIMENT

We first briefly describe the drawings.

DRAWINGS

STRUCTURE, MANUFACTURE, AND OPERATION

Figure 1:
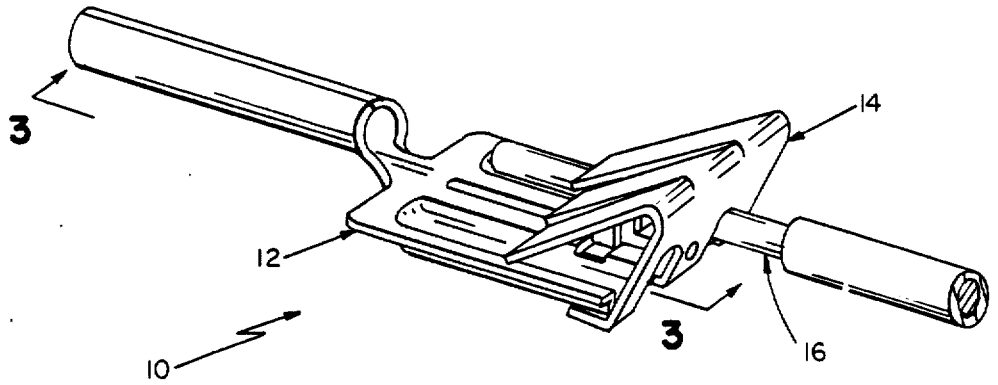
FIG. 1 is an isometric view of an electrical terminal holding a wire.

Referring to FIG. 1, a self-supporting electrical terminal 10 includes a stamped metal base 12 and a formed steel gripper 14 that together securely hold and make electrical connection to the free uninsulated end of a 12-gauge insulated copper wire 16. Base 12 is made of a brass alloy with very high copper content (Olin 194). Gripper 14 is made of high carbon content 420 stainless steel.

Figure 2:
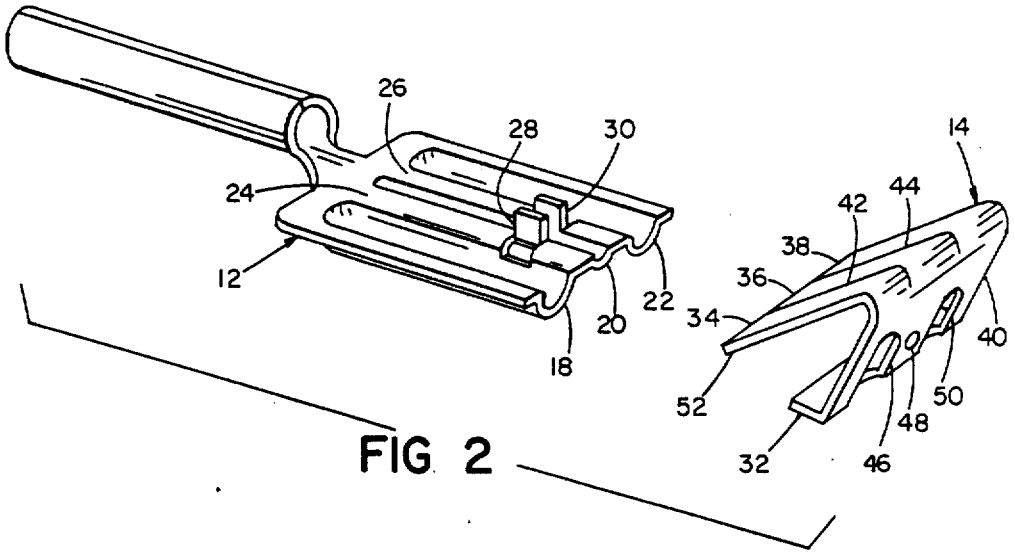
FIG. 2 is an exploded view of the terminal of FIG. 1.

Referring to FIG. 2, base 12 includes three troughs 18, 20, 22, for seating three separate wires. Troughs 18 and 22 are sized to snugly seat 12-gauge wires; trough 20 is smaller and is sized to snugly seat an 18-gauge wire. Troughs 18 and 20 and troughs 20 and 22 are respectively separated by shoulders 24, 26. On each shoulder 24, 26 is a flap 28, 30. Each trough is about ½" long and is shaped to assure contact with a substantial area of the surface of wire 16.

Gripper 14 is bent to form a supporting leg 32, a set of resilient gripping fingers 34, 36, 38, and a back portion 40 joining the supporting leg to the gripping fingers. Gripping fingers 34, 36, 38 are defined by parallel slits 42, 44. Fingers 34, 38 are slightly wider than finger 36. When assembled, fingers 34, 36, 38 respectively cooperate with troughs 18, 20, 22 (as shown in FIG. 1). The back portion 40 of gripper 14 has three openings 46, 48, 50 that can receive three wires (12-gauge wires in the case of openings 46, 50; 18-gauge wire in the case of opening 48). Fingers 34, 36, 38 have a burred edge 52 for biting into the surface of each wire.

Figure 3:
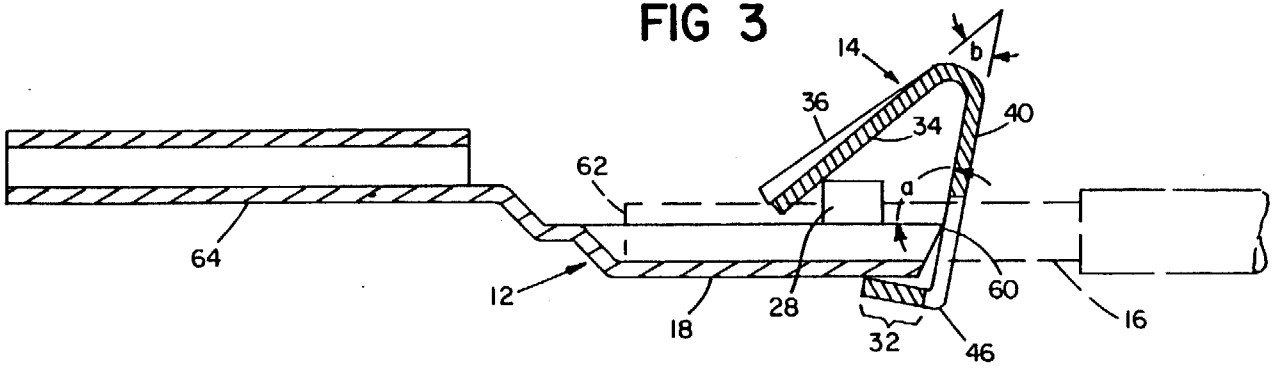
FIG. 3 is a side-sectional view at 3—3 of FIG. 1.

Referring to FIG. 3, when assembled, finger 36 is in tension against flaps 28, 30 and the back portion 40 is in contact at point 60 with the end of base 12 that is opposite the end 62 of wire 16, thus resisting the tension in finger 36. The supporting leg 32 is in contact with the bottom of base 12. The burred edge 52 bites into wire 16 to prevent it from being removed from the terminal (except by simultaneous twisting and pulling of the wire). Back portion 40 is perpendicular to supporting leg 32 and gripping fingers 34, 36, 38 are at 45° (angle b) to the back portion. When assembled, gripper 14 is slightly skewed relative to base 12 so that the angle (a) between back portion 40 and base 12 is slightly offset form 90° and the angle between each gripping finger and the base is slightly offset from 45°.

Finger 34 makes contact with base 12 at a point that is nearer to end 62 of wire 16 than the point at which supporting leg 32 makes contact with base 12. The pressure applied by fingers 34, 36, 38 is based on the resilience of those fingers and not on any resilience of back portion 40, or supporting leg 32. The relative short length of the resilient fingers and the configuration of the supporting leg and back portion helps to provide a strong pressure on base 12 and wires 16, assuring a tight connection.

Base 12 also includes a female receptacle 64 arranged to mate with a male prong (not shown in FIG. 3) of another terminal that is similar to terminal 10 except for the substitution of the prong for the receptacle.

Figure 4:
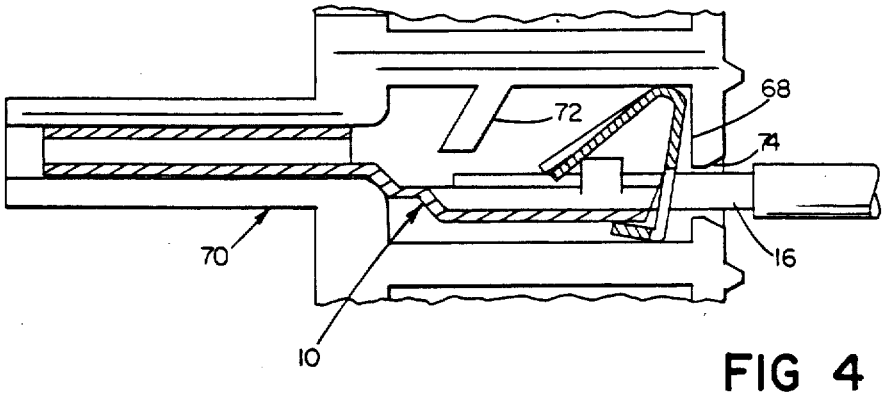
FIGS. 4 and 5 are top and side views of the terminal of FIG. 1 nestled in a representative section of a plastic housing.
Figure 5:
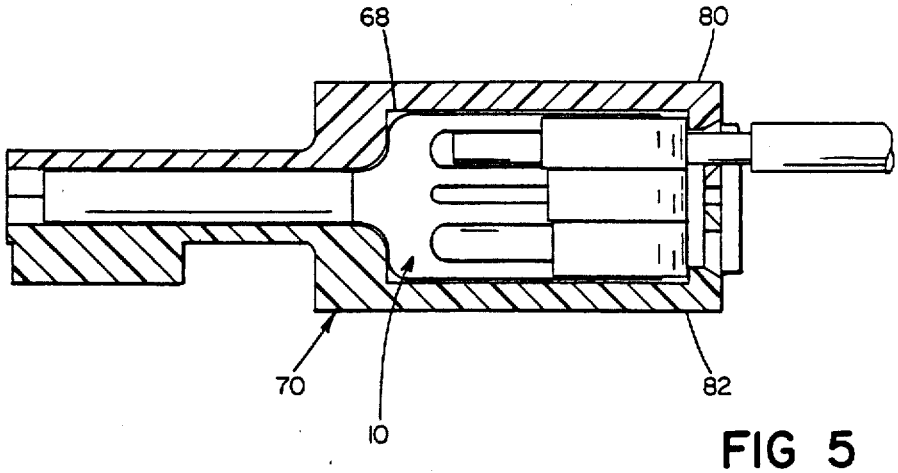

Referring to FIGS. 4, 5, terminal 10 is nestled within a chamber 68 in an insulative plastic housing 70. Although terminal 10 fits relatively snugly within chamber 68, terminal 10 does not require support from the walls of the chamber and remains self-supporting even if the housing 70 is distorted by heat flow. A tab 7 within chamber 68 helps to guide wire 16 into its trough during insertion. A hole 74 is provided colinear with each corresponding trough to receive each wire.

Figure 6:
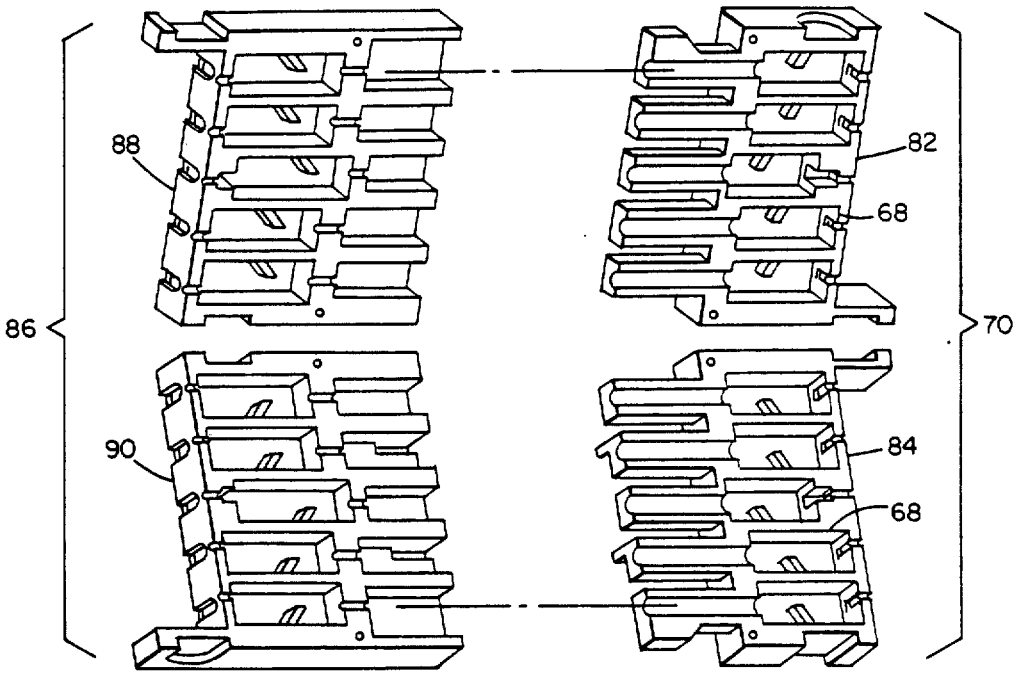
FIG. 6 is an isometric exploded view of male and female terminal housings.

Referring to FIG. 6, housing 70 has two mating sections 82, 84 which, when assembled, define chamber 68 and four other similar chambers in a row, each chamber being arranged to hold a terminal like terminal 10.

Female housing 70 mates with a male housing 86 that also has two mating sections 88, 90 that similarly define chambers for holding terminals that are the male counterparts of the terminals held in housing 70.

Figure 7:
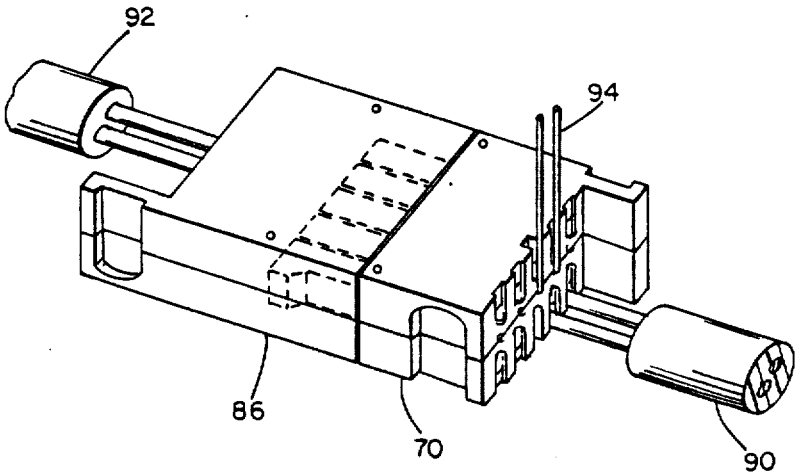
FIG. 7 is an isometric view of mated housings with cables.

Referring to FIG. 7, housing 70 and housing 86, with terminals enclosed, form mating male and female connectors that can be used to interconnect 12-gauge wires of one cable 90 and a second cable 92. Simultaneously, 18-gauge wires 94 can also be inserted into connector 70 to make connection to cable 90.

Figure 8:
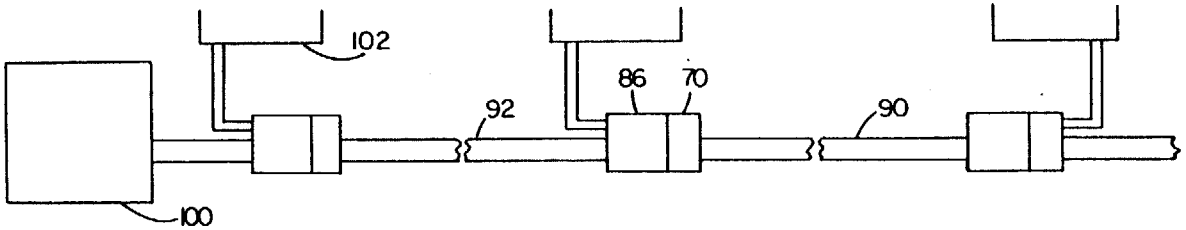
FIG. 8 is a diagram of a power distribution system.

Referring to FIG. 8, each cable 90, 92 can also have a second connector (of the opposite sex) attached to its other end to form modular cables that can be interconnected with other modular cables to distribute power from a source 100 to power using appliances 102 (e.g., fluorescent fixtures).

Figure 9:
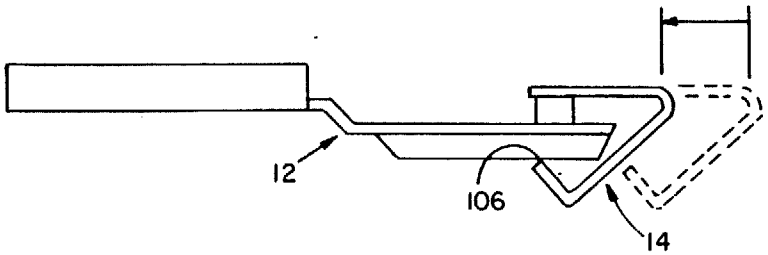
FIGS. 9, 10 illustrate assembly of the terminal.
Figure 10:
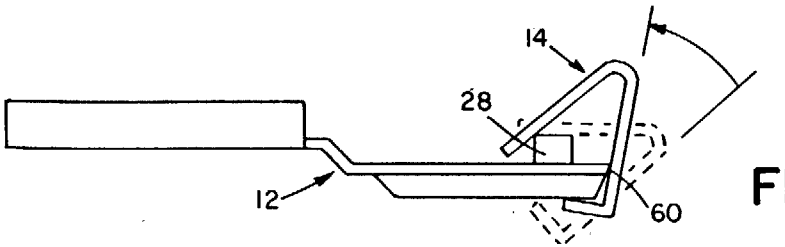

Referring to FIGS. 9, 10, in assembling each terminal, base 12 is inserted into the opening defined in gripper 14 between the gripping fingers and supporting leg to a position such that a free edge 106 of supporting leg is in contact with the bottom of base 12. Then the gripper is rotated into position such that finger 36 is in tension against flap 28 and back portion 40 touches the end 60 of base 12, resisting the tension in the finger. This produces a self-supporting assembly in which gripper 14 cannot move in either direction along base 12.

Next, each terminal is nestled into a chamber in one half of the plastic housing and the other half is placed over the terminals to form a connector. Finally, wires are inserted into appropriate ones of the terminals.

The terminal of the invention is easily, simply, and economically fabricated and is self-supporting without reguiring welding, stitching, or crimping. The terminal will retain the wire even though the material of the insulative housing may flow. The base can be easily and simply fabricated of high-conductivity material to provide an excellent electrical connection. The gripper can be easily and simply fabricated from heat-treatable stainless steel. Many wires of different gauge can be accommodated in a single terminal. Limiting the spring moment to a short section of the gripper and keeping the gripping finger at an angle of 45° to the supporting leg assures a secure connection. The troughs assure good contact and permit relatively easy insertion of the conductor. The barred edge assures a tight grip. The terminal can be part of an inexpensively fabricated modular cable or can be used to interconnect a number of individual wires.

Other embodiments are within the following claims.

Figure 11:
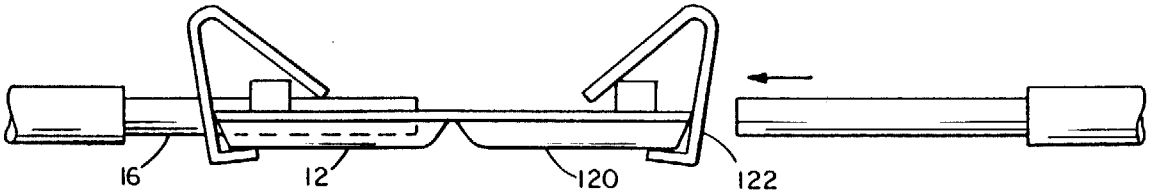
FIG. 11 is a side view of an alternate embodiment.

For example, referring to FIG. 11, base 12 can be extended to include a second set of troughs 120 that are identical to the original troughs but open in the opposite direction. A second gripper 122 identical to gripper 14 can be attached over troughs 120 to permit wires (e.g., wire 124) to be electrically connected to wire 16.

I claim:

1. A terminal for making an electrical connection to an electrical conductor comprising an elongated base, and a gripper comprising a resilient gripping finger and a back portion connected to said finger, said gripping finger being arranged to press said conductor into contact with said base, said gripper being held in a fixed position along the length of said base by the combination of said gripping finger acting in tension to exert a force on said base at first location along the surface of said base, said force being directed along the length of said base, while said back portion acts in the opposite direction at a second location spaced apart along said length of the base from said first location to resist said force.

2. The terminal of claim 1 wherein said gripper further comprises a supporting leg connected to said back portion, said supporting leg being arranged to contact said based on the opposite side from the side on which said conductor is pressed into contact.

3. The terminal of claim 1 wherein said base has a projection at said first location and an end at said second location.

4. The terminal of claim 3 wherein said base comprises sheet metal and said projection comprises a flap bent away from said metal sheet.

5. The terminal of claim 3 wherein said base comprises a trough for seating said free end of said conductor and a shoulder adjacent to said trough, and said projection is at said shoulder.

6. A terminal for making an electrical connection to an electrical conductor comprising a base, and a gripper comprising a supporting leg and a resilient gripping finger joined to said supporting leg by a back portion, said gripping finger being arranged to press said conductor into contact with a first side of said base with said conductor extending beyond said finger to a point where said conductor terminates, said supporting leg being arranged to contact said base on the opposite side from said first side, said contact by said supporting leg being made only at locations that are not as near to the point where said conductor terminates as the locations at which said gripping finger presses said conductor.

7. The terminal of claim 6 wherein said gripping finger presses said conductor at a single said location.

8. The terminal of claim 6 wherein said supporting leg comprises a flat portion that lies along said base beginning at an end of said base opposite the end of said conductor.

9. The terminal of claim 1, 6, or 8 adapted for making electrical connection to a plurality of said electrical conductors, and wherein said gripper comprises a plurality of said gripping fingers arranged to press said respective conductors into contact with said base.

10. The terminal of claim 9 wherein said gripping fingers are defined by parallel slits in said gripper.

11. A terminal for making an electrical connection to an electrical conductor comprising a base, and a gripper comprising a supporting leg and a resilient gripping finger joined to said supporting leg by a back portion, said gripping finger being arranged to press said conductor into contact with a first side of said base with said conductor extending beyond said finger to a point where said conductor terminates, said supporting leg being arranged to contact said base on the opposite side from said first side, said pressing of said conductor into contact with said base being accomplished only by the resilience of said gripping finger along a section that does not extend beyond an end of said base opposite said point where said conductor terminates.

12. The terminal of claim 11 wherein said gripping finger is flat and is oriented at an oblique angle to said conductor, and.

13. The terminal of claims 1, 6, or 11 wherein said gripping finger comprises a burred edge which presses against said conductor.

14. The terminal of claim 1, 6, or 11 wherein said base and said gripper cooperate to form a self-supporting assembly.

15. The terminal of claim 1, 6, or 11 wherein said base comprises high-copper-content brass.

16. The terminal of claim 1, 6, or 11 wherein said gripper comprises high carbon stainless steel.

17. The terminal of claim 1, 6 or 11 wherein said terminal is housed in an insulative housing.

18. The terminal of claim 1, 6, or 11 wherein said gripper is arranged to fit over and end of said terminal to hold a conductor at said one end, and said terminal further comprises a second gripper arranged to fit over another end of said terminal to hold another conductor at said other end.

19. The terminal of claim 1, 6, or 11 adapted for making electrical connection to a plurality of said electrical conductors, and wherein said base comprises a plurality of receptacles for respectively receiving said conductors.

20. The terminal of claim 19 wherein said receptacles comprise troughs formed in said base for seating said conductors.

21. The terminal of claim 1, 6, or 11 wherein said base comprises a trough for seating said conductor.

22. The terminal of claim 21 wherein said trough is shallower than the thickness of said conductor.

23. The terminal of claim 6 or 11 wherein said back portion comprises an opening for receiving said conductor.

24. The terminal of claim 23 wherein said base comprises a trough for receiving said conductor and said opening comprises a hole colinear with said trough.

25. The terminal of claim 1, 6, or 11 wherein said gripping finger is oriented at an acute angle to said supporting leg.

26. The terminal of claim 25 wherein said angle is 45° when said conductor is not being held in said terminal.

27. The terminal of claim 1, 6, or 11 wherein said conductor is a wire.

28. The terminal of claim 27 wherein said wire is 12 gauge.

29. The terminal of claims 1, 6, or 11 wherein said base further comprises a male prong or a female receptacle that mates with a prong or receptacle of another said terminal.

30. The terminal of 1, 6, or 11 further comprising metal surface for making electrical contact with said conductor.

31. The terminal of claim 30 wherein said base comprises said metal surface.

* * * * *

UNITED STATES PATENT AND TRADEMARK OFFICE

CERTIFICATE OF CORRECTION

PATENT NO. : 4,701,000

DATED : October 20, 1987

INVENTOR(S) : Paul W. Suprono

It is certified that error appears in the above-identified patent and that said Letters Patent is hereby corrected as shown below:

Col. 4, line 4, "tab 7" should be --tab 72--.
Col. 6, claim 12, line 14, delete "." and add the following:
--said back portion is flat and is oriented perpendicular to said supporting leg.--.
Col. 6, claim 18, line 27, replace "and" with --one--.

Signed and Sealed this

Twelfth Day of December, 1989

*Attest:*

JEFFREY M. SAMUELS

*Attesting Officer* *Acting Commissioner of Patents and Trademarks*